United States Patent [19]

Kita

[11] Patent Number: 4,781,104

[45] Date of Patent: Nov. 1, 1988

[54] ROTARY FLUID ENERGY TRANSLATION DEVICE

[75] Inventor: Yasuo Kita, Kyoto, Japan

[73] Assignee: Shimadzu Corporation, Kyoto, Japan

[21] Appl. No.: 921,081

[22] Filed: Oct. 21, 1986

[51] Int. Cl.[4] ..... F01B 13/06

[52] U.S. Cl. ..... 91/497; 91/472; 417/218; 417/237

[58] Field of Search ..... 91/472, 497; 60/408; 92/12.1; 417/221, 237, 324, 411, 218

[56] References Cited

U.S. PATENT DOCUMENTS

| | | | |
|---|---|---|---|
| 1,236,922 | 8/1917 | Gibbs | 60/408 |
| 3,771,921 | 11/1973 | Rohde et al. | 417/237 X |
| 3,828,400 | 8/1974 | Mason et al. | 91/497 |
| 4,137,826 | 2/1979 | Kita | 91/497 |
| 4,531,898 | 7/1985 | Ideta | 417/220 X |
| 4,598,628 | 7/1986 | Courtright | 417/273 X |
| 4,631,000 | 12/1986 | Burandt | 417/237 X |

FOREIGN PATENT DOCUMENTS

| | | | |
|---|---|---|---|
| 78513 | 5/1983 | European Pat. Off. | 91/472 |
| 55372 | 3/1986 | European Pat. Off. | 91/497 |
| 85583 | 7/1981 | Japan | 417/420 |
| 55376 | 3/1986 | Japan | 417/218 |

*Primary Examiner*—Carlton R. Croyle
*Assistant Examiner*—Paul F. Neils
*Attorney, Agent, or Firm*—Armstrong, Nikaido, Marmelstein & Kubovcik

[57] ABSTRACT

A rotary fluid energy converter which can be used either as a hydraulic pump or as a motor, can recover energy with high efficiency. The converter has a spring for biasing a pintle, which supports a torque ring, in one direction, and a hydraulic actuator for moving the pintle in the opposite direction against the action of the spring. A high pressure fluid used in the converter is introduced into the actuator via a pressure-compensating valve to maintain the pressure of this fluid at the pressure set for the valve at all times.

2 Claims, 4 Drawing Sheets

ROTARY FLUID ENERGY TRANSLATION DEVICE

FIELD OF THE INVENTION

The present invention relates to a rotary fluid energy converter that is used as a hydraulic pump or motor having a variable displacement.

BACKGROUND OF THE INVENTION

A rotary energy converter of this type, or hydrostatic rotary fluid pump/motor, has two members which are rotated relative to one another to increase or decrease the volume of a space for intaking or discharging fluid. Thus, the converter can be used either as a pump or as a motor. A support element that supports one of the two members is reciprocated at right angles to an axis of rotation to adjust the distance between the centers of the two members for changing the displacement of the converter. This structure is customarily called a variable-displacement type structure.

Recently, hydraulically driven systems of the power recovery type have been required to maintain a constant pressure regardless of whether discharging or intaking fluid. In this respect, the energy converter of the variable displacement type is equipped with a pressure-compensating mechanism, and the displacement can be varied such that when the load pressure reaches a certain preset value, the discharge of the pump is adjusted according to the discharge pressure. Such energy converter performs the control over the pressure which is now described in more detail by referring to FIG. 4. When the pump operates at a certain flow rate a, if the discharge pressure increases to a preset pressure, then the pressure-compensating valve opens, gradually reducing the discharge rate as indicated by b. Thus, the displacement varies automatically to a non-discharging condition. Consequently, the present situation is that an energy converter of this kind cannot be switched between pump and motor at will, nor can it recover energy efficiently.

SUMMARY OF THE INVENTION

In view of the foregoing difficulties, it is an object of the present invention to provide a rotary fluid energy converter capable of recovering energy with very high efficiency, not achieveable by conventional energy converters equipped with the above described pressure-compensating mechanism.

In one embodiment of the invention, the rotary fluid energy converter comprises a spring member for urging the support element to displace it to one side of an axis of rotation; a hydraulic actuator for moving the support element displaced to the one side of the axis of rotation across the axis of rotation to the opposite side against the action of the spring member; and a pressure-compensating valve through which a higher pressure is introduced into the actuator so that the pressure of this fluid is maintained at a compensated pressure.

In another embodiment of the invention, in addition to the above-mentioned components of the first embodiment, the fluid energy converter further comprises a balance piston which introduces the high pressure fluid used in the converter to produce a corresponding pressure in order to cancel out the unbalanced force acting on the support element.

In the structure constructed according to the above-mentioned embodiments, when the converter is used as a pump, the spring member urging the support member holds the element at a position displaced from the axis of rotation in one direction, whereby the pump is capable of having a certain displacement. When the pressure of a higher pressure fluid used in the pump exceeds a preset value, the hydraulic actuator is operated to move the support element in the opposite direction against the action of the spring member. At this time, the converter acts as a motor. In this case, power is taken from the rotating shaft of the motor that rotates in the same direction as said pump. When the converter functions as such a motor, if the pressure of the high pressure fluid drops below the preset value, then the converter returns to its original state. Accordingly, it then acts as a pump. The pressure of the high pressure fluid is kept at the pressure set for the pressure-compensating value, whether the converter acts as a pump or as a motor.

Especially in the structure constructed according to the above-mentioned second embodiment, the support element is supported by the balance piston utilizing the pressure of the high pressure fluid of the converter, in such a way that the urging force of the spring member is augmented. Therefore, the load imposed on the spring member is reduced. This effectively eliminates the limitations imposed in designing it.

DETAILED DESCRIPTION OF THE INVENTION

Figure 1:
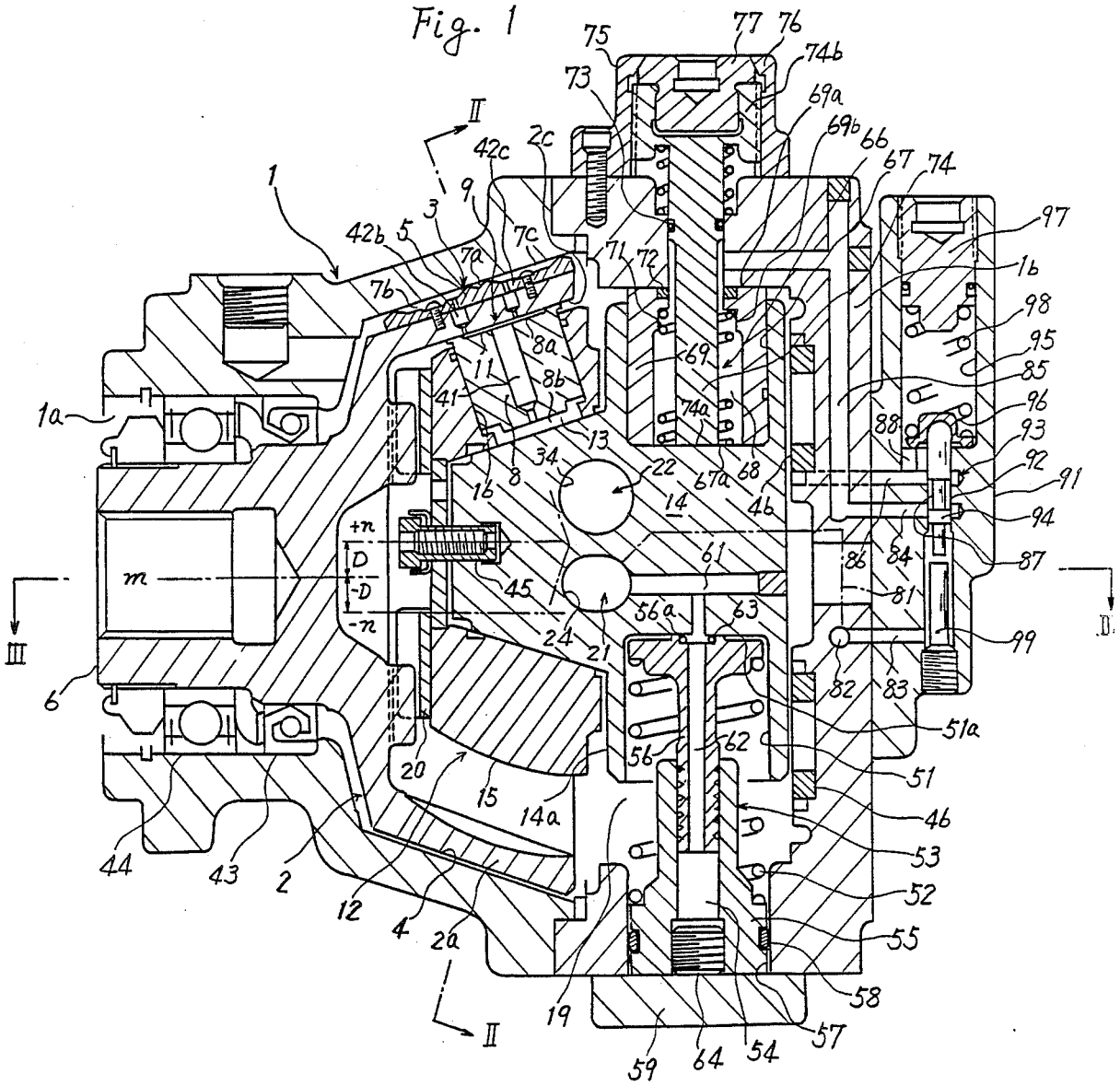
FIG. 1 is a cross-sectional view of a rotary fluid energy converter according to the invention.
Figure 2:
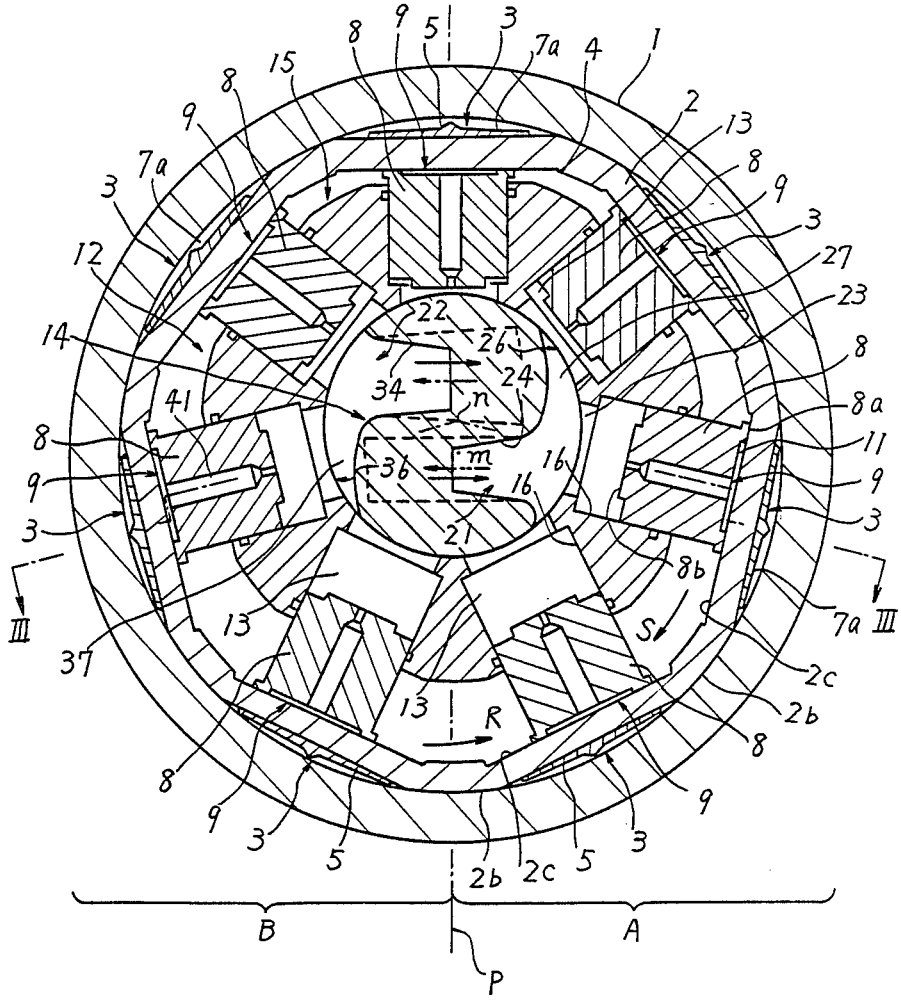
FIG. 2 is a cross-sectional view taken on line II—II of FIG. 1.
Figure 3:
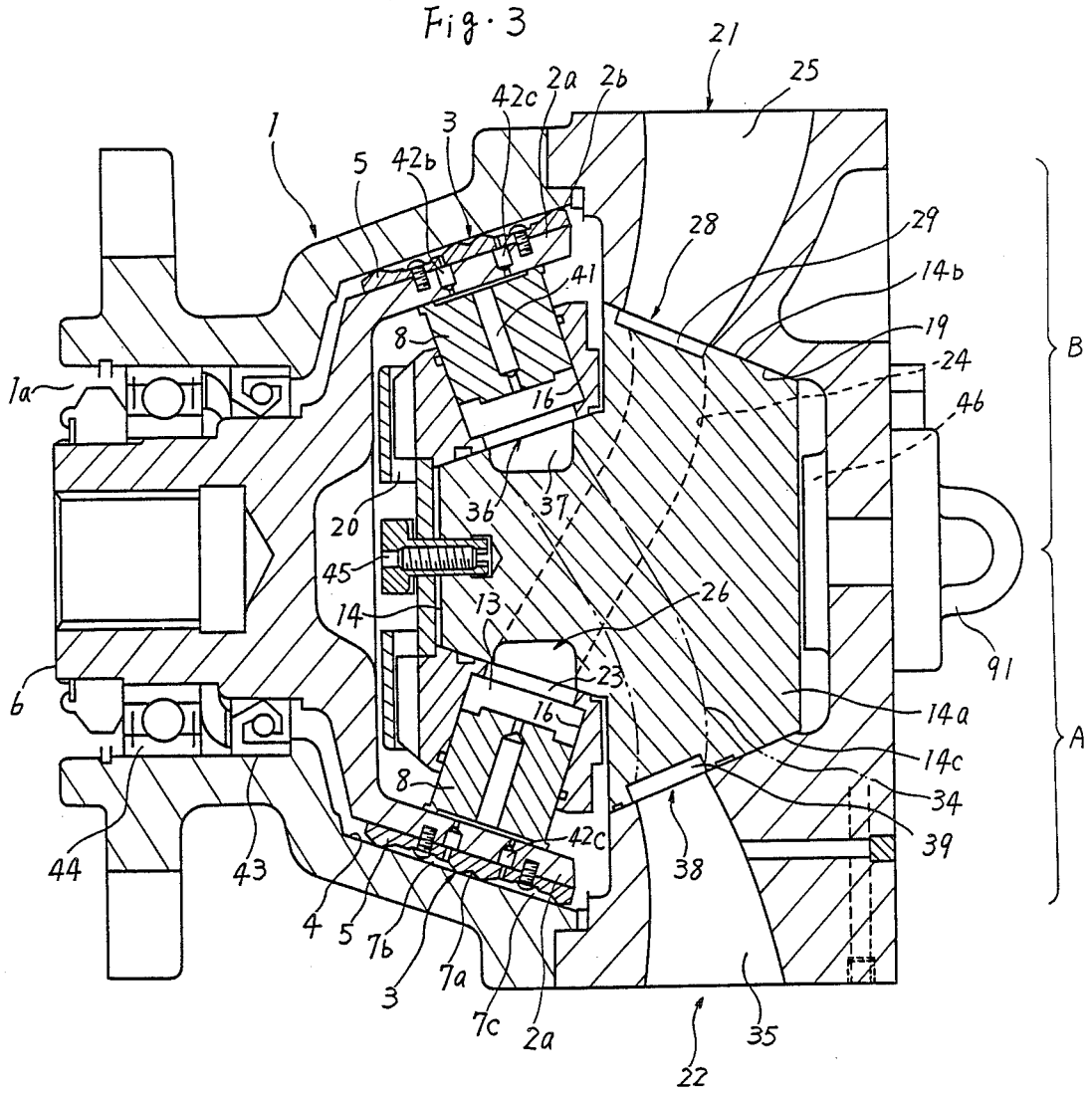
FIG. 3 is a cross-sectional view taken on line III—III of FIG. 1.
Figure 4:
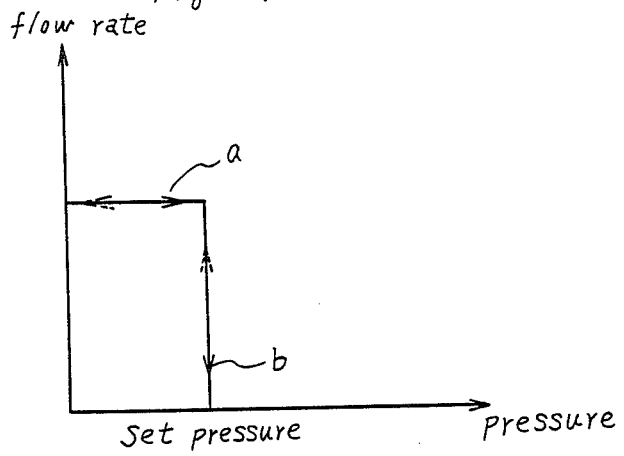
FIG. 4 is a graph for illustrating the operational characteristics of an energy converter equipped with a conventional pressure-compensating function.

Referring to FIGS. 1–3, there is shown a rotary fluid energy converter according to the invention. This energy converter has a housing 1 that constitutes a first member. The converter also has a torque ring 2 that constitutes a second member. The ring 2 is rotatably held against the inner surface of the housing 1 via first static pressure bearings 3. The housing 1 assumes the form of a cone having a bottom, and is provided with an opening 1*a* at its one end. A surface 4 tapering off toward the opening 1*a* is formed in the portion of the inner surface of the housing 1 on which the ring 2 bears. The ring 2 is shaped like a cup, and has a peripheral wall 2*a* that makes the same cone angle as the tapering surface 4. A rotating shaft 6 protrudes from one end of the axially central portion of the ring 2. The front end of the shaft 6 extends outwardly from housing 1 through the opening 1*a*.

The first static pressure bearings 3 have shoes 5 rigidly secured to the outer periphery of the ring 2 at requisite positions. The shoes 5 are attached to the tapering surface 4 of the housing 1. Each shoe 5 is provided with three pressure pockets 7*a*, 7*b*, 7*c* axially neighboring one another. Fluid pressure is introduced into these pockets 7*a*, 7*b*, 7*c*. An odd number of pressure bearings 3 are circumferentially and regularly spaced from one another. Flat surfaces 2c are formed in the inner surface of the ring 2 at locations corresponding to first bearings 3. Pistons 8 are disposed at locations corresponding to the flat surfaces 2c of the inner surface of the ring 2. The front ends 8a of the pistons 8 are connected to their respective inner surfaces 2c via second static pressure bearings 9, which are made planar so that the front ends 8a of the pistons 8 make intimate contact with the inner surfaces 2c. Pressure pockets 11 are formed in the front ends 8a, and pressure fluid is introduced into them.

The bottom ends of the pistons 8 are held by a piston holder 12. Spaces 13 are formed between the piston holder 12 and each piston 8 so that fluid may be introduced into them. More specifically, the piston holder 12 consists of a pintle 14 and an annular cylinder barrel 15 fitted over the outer periphery of the pintle 14. The axis n of the pintle 14 is parallel to the axis of both the housing 1 and the ring 2, i.e., the axis of rotation m. In the illustrated embodiment, when the converter is used as a pump, the axis of the pintle is located at +n, and when it is used as a motor, the axis is located at −n. The pintle 14 has a sliding portion 14a carried on the housing 1. The barrel 15 is equipped with cylinders 16 which are circumferentially and regularly spaced from one another. The axes of the cylinders are substantially perpendicular to the outer periphery of the pintle 14. The pistons 8 are fitted in the respective cylinders 16 so as to be slidable therein. The bottom end surfaces 8b of the pistons 8 cooperate with the inner surfaces of the cylinders 16 to form the spaces 13. The cylinder barrel 15 is connected to the torque ring 2 via an Oldham coupling 20 or similar means, and rotates at the same angular velocity as the ring 2.

The contour of the pintle 14 takes the form of a truncated cone having substantially the same cone angle as the peripheral wall 2a of the ring 2. The pistons 8 are held in such a way that they can move perpendicularly to the peripheral wall 2a of the ring 2. The sliding portion 14a of the pintle 14 is shaped into a vertically elongated block of trapezoidal cross section. The housing 1 is formed with a trapezoidal groove 19 in which the sliding portion 14a is fitted so as to be slidable. That is, the pintle 14 is so held as to be slidable in a direction vertical to the axis m of the housing 1. This makes it possible to adjust the distance +D between the axis +n of the pintle 14 and the axis m of the housing 1 to any desired value, including zero.

As shown in FIG. 2, the inside of the housing 1 is divided into a first region A and a second region B by an imaginary line P drawn in the direction in which the pintle 14 slides. Any space 13 passing across the first region A is placed communication with a first fluid communication passage 21. Any space 13 passing across the second region B is placed in communication with a second communication passage 22.

The first fluid communication passage 21 comprises cylinder ports 23, a port 24 extending through the pintle 14, and a fluid inlet/outlet port 25 formed in the housing 1. The ports 23 permit the spaces 13 to have access to the inner surface of the cylinder barrel 15. One end of the port24 extends to the outer periphery of pintle 14 in the first region A, while the other end extends to an inclined surface 14b of the sliding portion 14a of the pintle 14 in the second region B. The port 25 corresponds in position to the other end of the port 24. Formed at one end of the port 24 is a pressure pocket 27 that is used to form a third static pressure bearing 26 between between the outer periphery of the pintle 14 and the inner surface of the cylinder barrel 15. Formed at the other end of the port 24 is a pressure pocket 29 that is employed to form a fourth static pressure bearing 28 between the inclined surface 14b of the pintle 14 and the inner surface of the housing 1. The pocket 27 is elongated circumferentially, and acts to place all the spaces 13 existing in the first region A in communication with the port 24 extending through the pintle 14. The pocket 29 is elongated in the direction in which the pintle 14 slides, and serves to prevent the inlet/outlet port 25 from being disconnected from the port 24 when the pintle 14 is slid.

The second fluid communication passage 22 comprises cylinder ports 23, a port 34 extending through the pintle 14, and a fluid inlet/outlet port 35 formed in the housing 1. One end of the port 34 extends to the outer periphery of the pintle 14 in the second region B, while the other end extends to an inclined surface 14c of the sliding portion 14a of the pintle in the first region A. The inlet/outlet port 35 corresponds in position to the other end of the port 34. A pressure pocket 37 is formed at one end of the port 34 to form a third static pressure bearing 36 between the pintle 14 and the cylinder barrel 15. Formed at the other end of the port 34 is a pressure pocket 39 that is employed to form a fourth static pressure bearing 38 between the inclined surface 14c of the pintle 14 and the inner surface of the housing 1. These pressure pockets 37 and 39 are similar in structure to the pressure pockets 27 and 29.

In the system constructed as described above, the fluid pressure within the spaces 13 corresponding to the pistons 8 is introduced into the pressure pockets 11 of the corresponding second static pressure bearing 9 via a pressure inlet passage 41 formed along the axis of the piston 8. Then, the fluid pressure inside the pockets 11 is introduced into the pressure pockets *7a, 7b, 7c* of the corresponding first static pressure bearing 3 via fluid passages 42a, 42b, 42c formed in the torque ring 2. The directions and area of the bearings 3 and 9 are so set that the force acting on the ring 2 due to the static pressure of the fluid introduced into the first bearings 3 is equal in magnitude but opposite in direction to the force acting on the ring 2 due to the static pressure of the fluid introduced into the second bearings 9. The area of the second bearings 9 is fixed so that the force acting on the pistons 8 due to the static pressure of the fluid introduced into the second bearings 9 is canceled by the force acting on the pistons 8 due to the static pressure of the fluid inside the spaces 13. Also, the area of the third static pressure bearings 26 and 36 is such that the force acting on the cylinder barrel 15 due to the static pressure introduced into the bearings 26 and 36 is canceled by the force acting on the barrel 15 due to the static pressure of the fluid within the spaces 13 existing in the respective regions A and B. Further, the angle at which surfaces 14b and 14c, having the fourth bearings 28 and 38, are inclined is fixed so that the force acting on the pintle 14 due to the static pressure of the fluid introduced into the fourth bearings 28 and 38 is canceled by the force acting on the static pressure of the fluid introduced into the third bearings 26 and 36 existing in the respective regions A and B corresponding to the inclined surfaces 14b and 14c.

Also shown are seal members 43 and bearings 44 for auxiliary support of the rotating shaft. The cylinder barrel 15 is firmly fixed to the pintle 14 with a fixing element 45. A permanent magnet 46 pulls the pintle 14 toward the inner surface of a rear cover 1b of housing 1.

The hydrostatic fluid energy converter constructed as described above is further equipped with the following means for displacing the pintle 14 that supports the torque ring, or the second member, at right angles to the axis of rotation. The pintle 14 has the sliding portion 14*a* taking the form of a block at its bottom end, and this sliding portion 14*a* is fitted in the groove 19 in the housing 1. The sliding portion 14*a* is provided with a recess 51 that extends from one longitudinal end of the sliding portion perpendicularly to the axis of rotation. A spring member 51 is mounted between the inner bottom surface 51*a* of the recess 51 and the inner surface of the housing. The pintle 14 is displaced into the eccentric position +n described above by the biasing force of the spring member 52. A hydraulic means 53 is also provided which produces a force working together with the urging force of the spring member 52.

This hydraulic means 53 is composed of a cylindrical member 55 and a balance piston 56 slidably fitted within cylindrical member 55. The cylindrical member 55 has an introduction portion 54 through which working fluid enters. The cylindrical member 55 is fitted in a mounting hole 57 via a seal 58, the hole 57 being formed in the housing 1 and in communication with the recess 51. The outer surface of the cylindrical member 55 bears on a sealing member 59, and the member 55 is rigidly fixed to the housing 1. The front surface 56*a* of the piston 56 abuts against the inner bottom surface 51*a* of the recess 51. The spring member 52 is sandwiched between the rear surface of the front surface 56*a* of the piston of the hydraulic means 53 and the bottom surface of the cylindrical member 55. The pintle 14 is biased by the spring member 52 via the balance piston 56. The hydraulic means 53 always introduces the high pressure fluid that is forced out of or into the converter into its introduction portion 54, and is able to give a supporting force that adds to the biasing force to the pintle 14.

More specifically, the illustrated energy converter is equipped with a hydraulic circuit that has the port 24 extending through the pintle, a fluid passage 61 branching off from the port 24 and extending to the inner bottom surface 51*a* of the recess, and another fluid passage 62 extending axially through the piston 56. The port 24 communicates with the fluid inlet/outlet port 25 which is positioned so that the high pressure fluid is forced into and out of the converter through the port 25. The front end surface 56*a* of the balance piston is in intimate contact with the inner bottom surface 51*a*. One end of the passage 62 is connected to the open end of the passage 61, while the other end is connected to the introduction portion 54. In this way, the high pressure fluid is always transmitted to the introduction portion 54. That is, the hydraulic means 53 invariably supports the pintle 14 with a force that is the cross-sectional area of the cylinder multiplied by the pressure of the introduced high pressure fluid. On the front end surface 56*a* of the balance piston, the passages 61 and 62 are connected together via a seal 63 to prevent the working fluid from leaking onto the contact surface. A threaded rod 64 is screwed to the inner bottom end of the cylindrical member 55. When the piston 56 is retracted into the cylindrical member, i.e., when the pintle 14 is urged toward the other end against the biasing force of the spring member 52, the piston 56 bears against threaded rod 64, whereby the pintle 14 cannot move further. Since the rod 64 is screwed to the cylindrical member 55, the position of the rod can be adjusted forward or rearward. That is, the threaded rod 64 acts to limit the displacement of the pintle 14 to a certain amount. In this specific embodiment, the pintle 14 is brought to a standstill at the eccentric position −n that is −D distant from the axis m of the housing 1.

The energy converter is further equipped with a hydraulic actuator 66 that utilizes a pressure-compensating mechanism incorporated in the converter, in order to urge the pintle 14 in the opposite direction against the action of the spring member 52 and the hydraulic means 53. More specifically, the block 14a of the pintle is provided with a recess 67 that extends at right angles to the axis of rotation in opposed relation to the recess 51, the block 14*a* being fitted in the groove 19 of housing 1. A cylindrical member 69 is fitted in the recess 67 so as to be slidable on the inner surface of the recess 67. The cylindrical member 69 incorporates an introduction portion 68 for working fluid. A spring member 71 is mounted between a retaining step 69*b* formed on the inner bottom surface 67*a* of the recess 67. When the cylindrical member 69 is moved, the bottom end surface is maintained in intimate contact with the inner surface of the housing 1. The top end surface 69*a* of the cylindrical member bears on the inner surface of the housing via a seal 72 to prevent working fluid from leaking on the contact surface. A pintle support rod 74 extends from outside the housing 1 through the hollow inside of the cylindrical member 69 across a mounting hole 73 in the housing 1, the member 69 being fitted in the recess 67 in the pintle 14. The front end surface 74*a* of the rod 74 bears on the inner bottom surface 67*a* of the recess 67. A suitable member 75 is mounted between the inner surface of the head 74*b* of the rod 74 and the outer surface of the housing 1, the head 74*b* protruding from the housing 1. A support cap 76 is firmly fixed to the housing 1, and the head 74*b* is fitted in this cap 76. A locking bolt 77 is fitted in the top of the cap. The distance between the cylindrical member 69 and the front end surface 74*a* protruding from the member 69 can be adjusted by tightening or loosening the bolt 77. The pintle support rod 74 serves to limit the displacement of the pintle 14 in one direction that is caused by the action of the spring member 52, etc. In this specific embodiment, the pintle 14 is brought to a standstill at the eccentric position +n, that is D distant from the axis of the rotation m of the housing 1.

The hydraulic actuator 66 for shifting the pintle in this way is equipped with a hydraulic pressure circuit for forcing the high pressure fluid in the energy converter into the introduction portion 68 in the cylindrical member 69 via a pressure-compensating valve. This hydraulic pressure circuit comprises the port 24 extending through the pintle, a fluid passage 81 schematically shown in FIG. 1 as indicated by the dot-and-dash line, and other fluid passages 83, 84, 85. The port 24 communicates with the fluid inlet/outlet port 25 which is positioned so that the high pressure fluid in the converter is forced into and out of the port 25 as mentioned already. The passage 81 branches off from the port 24, and acts to introduce working fluid into a port 82 formed in the rear cover 1*b* of the housing 1. The passage 83 is in communication with a fluid passage 92 formed in a block 91 that incorporates a pressure-compensating mechanism. The block 91 bears on the rear cover 1*b* of the housing 1. Working fluid is introduced from the passage 92 in the block into the housing 1 via a pressure-compensating valve 93 and also via the passage 84. One end of the passage 85 is connected to the passage 84, while the other end is connected to the introduction portion 68 in the cylindrical member 69 and also to the mounting hole 73 formed in one side wall of the housing 1, the rod 74 extending through the hole 73. The pressure-compensating valve 93 incorporated in the block 91 is designed to insert a spool 94 in the fluid passage 92 and to hold and bias the spool according to a preset operating pressure, in such a way that the spool 94 is able to slide. More specifically, the spool 94 has a land that makes sliding contact. This land is so located in the passage 92 as to fully bridge the opening of the passage 84. The moving front end of the spool 94 faces a larger support hole 95 connected to the passage 92. A spring member 98 is mounted between a retaining plate 96 positioned on the front end of the spool 94 and the inner surface of a locking bolt 97 that is fitted in a support hole 95 on the opposite side. The biasing force of the spring member 98 can be controlled by tightening or loosening the bolt 97.

When the pressure of the high pressure fluid that is transmitted in the converter through the fluid passage 83 overcomes the biasing force of the spring member 98, i.e., the pressure set for the pressure-compensating valve 93, the spool 94 slightly slides toward the front end, whereupon the spool 94 brings the fluid passage 84 into communication with the fluid passage 92. This permits the high pressure fluid to be forced into the hydraulic actuator 66 that biases the pintle 14. Of course, when the pressure of the high pressure fluid drops below the set value, the spool 94 returns to its original state, cutting off the supply of the high pressure fluid into the actuator 66. After returning from the actuator 66, working fluid is caused to flow via fluid passages 86, 87, 88 into a case drain facing the inner surface of the housing. A stopper 99 is used to maintain the spool 94 in the restored condition.

When working fluid is introduced into the hydraulic actuator 66 from a high pressure side of the converter via the pressure-compensating valve 93, the pintle 14 is moved to the other side in opposition to both the biasing force of the spring member 52 and the force exerted by the balance piston 56. The force exerted upon the pintle 14 by the actuator 66 is equal to the area of the inner bottom surface 67*a* of the recess 67 multiplied by the pressure of the introduced high pressure fluid, the recess 67 forming the introduction portion for working fluid. The force displaces the pintle 14 into the eccentric position −n. Therefore, the output power of the actuator 66 is much larger than the force exerted by the balance piston 56 which overcomes the opposing, biasing force. For these purposes, the characteristics of the spring member 52 are determined based on the force exerted by the actuator 66 and also by the balance piston 56 such that when the pressure of the high pressure fluid in the converter increases from the pressure set for the pressure-compensating valve 93, the pintle 14 can be smoothly displaced. The characteristics of the spring member 52 are also set in such a manner that when the pressure of the high pressure fluid in the converter reaches the pressure set for the valve 93 and is about to actuate the actuator 66, the sum of the force of the spring member 52 and the force of the piston 56 is still larger somewhat than the force acting on the actuator. Immediately after the set pressure is surpassed, the pintle 14 is quickly shifted to the opposite side. As already mentioned, when the pintle is displaced in this way, the threaded rod 64 in the hydraulic means 53 limits the displacement of the pintle 14.

The operation of the illustrated converter is now described. When the axis of the pintle 14 is set at the position +n and the torque ring 2 is rotated by an external force in the direction indicated by the arrow R, high pressure fluid is discharged from the first fluid communication line 21. Thus, the converter acts as a pump. When the axis of the pintle 14 is set at the position −n and high pressure fluid is supplied into the spaces 13 existing in the first region via the first line 21, a force is produced which rotates the ring 2 in the direction indicated by the arrow S. Hence, the converter acts as a motor. When the converter is used either as a pump or as a motor at the corresponding position of axis of rotation, the shaft 6 of the converter is rotated in a certain direction.

The manner in which the converter is operated while varying its capacity will now be described. It is first assumed that the converter is used as a source of hydraulic pressure and that this pressure is supplied to a hydraulically driven engine or motor, and for example a return line from the hydraulically driven motor may be applied to the input of the subject converter. Where the converter is run as a pump under the condition that the axis of the pintle 14 is located at the eccentric position +n, the pump discharges fluid from the first fluid communication line 21 that is placed on the high pressure side, at a flow rate determined by the eccentricity. When the high load pressure, or the discharge pressure, reaches a certain preset value, the pressure-compensating valve 93 opens, the valve 93 being mounted in the hydraulic pressure circuit through which the high pressure fluid flows. Then, the hydraulic actuator 66 allows the pressure to be admitted in to its introduction portion 68. If the pressure shows a tendency to increase at all, then the actuator 66 displaces the pintle 14 to transiently reset the discharge of the pump for the discharge pressure. If the pressure increases further, the actuator 66 overcomes the action of both the spring member 52 and the balance piston 56 to move the axis of the pintle 14 to the eccentric position −n determined by the aforementioned limiting means, i.e., the axis of rotation, to the opposite side. When the pintle 14 is fully displaced, the converter functions as a pump that discharges fluid from the first fluid line 21 at a negative flow rate. That is, the converter is automatically changed to a motor that rotates in the same irection by permitting the high pressure fluid returned from the above hydraulic motor, for example, to flow into it.

Figure 5:
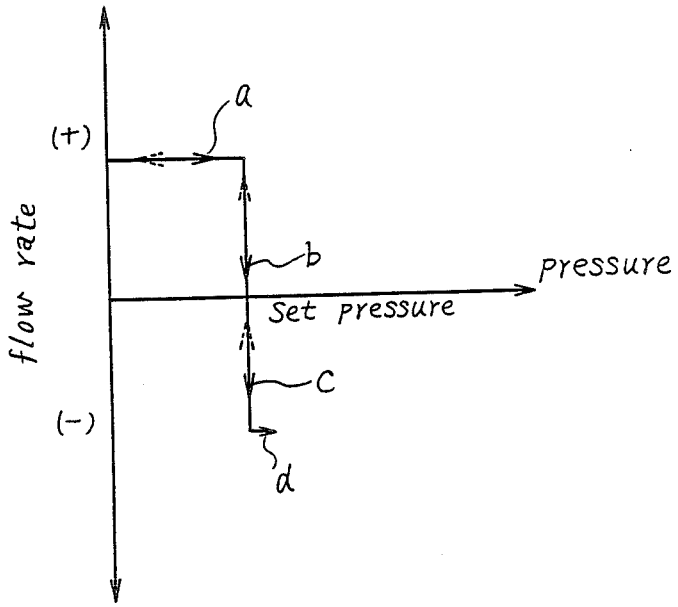
FIG. 5 is a graph for illustrating the operational characteristics of the converter according to the invention.

The displacement of the converter varies in this way, and the relation of the flow rate of this converter to the load pressure is shown in FIG. 5. In a pump equipped with the prior art pressure-compensating function, the discharge is controlled simply according to the discharge pressure as indicated by a and b. In contrast, in the instant pump, when the preset value is exceeded, the pressure corresponding to the pressure set for the pressure-compensating valve is maintained substantially constant as indicated by c and, at the same time, the amount of fluid introduced from the high pressure side is gradually increased until its certain capacity is reached. Then, the converter is driven as a motor by the hydraulic energy of the high pressure fluid. For example, if a dynamo that rotates in one direction is connected to the rotating shaft 6 of the converter, and if it is used as motor under conditions indicated by c and d, then the fluid energy can be recovered. Because of this function of energy recovery, the converter can be run while economizing on energy.

In the embodiment described thus far, the pintle 14 is held and displaced by the biasing force of the spring member 52 and also by the force exerted by the balance piston 56. The use of the piston 56 is not basically essential to the invention. Namely, it is possible to displace and hold the pintle 14 only by the biasing force of the spring member 52 and to balance this by the force exerted by the hydraulic actuator 66 that displaces the pintle.

In practicing the invention, it is advantageous to install the balance piston 56 as in the embodiment above for the following reasons. In the hydrostatic converter as described above, when the axis of the pintle is brought into the eccentric position +n and the converter is employed as a pump, the forces acting on the pintle 14 which is a support element are theoretically canceled out and so no displacing force is developed. In practice, however, the compressibility of working fluid delays changes in the pressure inside the spaces 13, and the force not canceled urges the pintle 14 toward its neutral position. Therefore, if the pintle 14 is supported only by the spring member 52, this member is required to exert a considerably large biasing force. Further, since a long stroke is needed for the displacement as mentioned previously, it is very difficult to appropriately design the spring member 52. For instance, if it were designed inappropriately, the maximum allowable shear stress of a coiled spring may be exceeded. If the number of turns were increased, the spring would easily buckle. Hence, it would be difficult or dangerous to assemble or disassemble it. In a case where the pintle 14 is supported by the use of the balance piston 56, such difficulties do not arise. Therefore, ideal characteristics can be imparted to the spring member 52. This enables the converter to have a mechanism for stably varying the capacity.

Of course, the structure of the body of the inventive converter acting either as a pump or as a motor is not limited to the structure in the illustrated embodiment. For example, it may be an ordinary pump or piston of the radial piston type. It is also to be noted that the balance piston includes balance pistons shaped like a plunger.

Since the novel converter is constructed as described thus far, it is automatically switched between two modes of operation in which it acts as a pump and as a motor, respectively, according to the high pressure while maintaining a constant direction of rotation of the rotating shaft. Consequently, it can recover energy with high efficiency that cannot be accomplished by an energy converter equipped with the conventional pressure-compensating function.

I claim:

1. A rotary piston fluid energy converter comprising:

first and second members which are rotated relative to one another;

a cylinder barrel having a plurality of substantially radially disposed cylinders, wherein each cylinder has a piston disposed therein;

a support element which supports said second member through said cylinder barrel and pistons, wherein said support element and said cylinder barrel are rotatable with respect to one another, and wherein said support element is displaceable perpendicularly with respect to an axis of rotation, in order to adjust the distance between centers of the first and second members and the center of the support element, and further wherein spaces are formed in said cylinders between said pistons and said support element, such that when said support element is displaced from said axis of rotation said spaces increase or decrease when rotated, so that said convertr acts as either a pump or a motor, and further wherein said support element is displaceable in a first direction to form a pump, and in a second direction to form a motor;

a spring member for biasing the support element in said first direction;

a dydraulic actuator for displacing the support element in said second direction against the action of the spring member; and a pressure compensating valve through which a high pressure fluid used in the converter is introduced into the actuator when said high pressure fluid exceeds a preset pressure valve to cause the converter to operate as a motor, when the converter is supplied with an input of high pressure fluid, and when said high pressure fluid does not exceed said preset pressure value, said high pressure fluid is prevented from communicating with said actuator by said pressure-compensating valve so that the converter acts as a pump.

2. A rotary piston energy converter, comprising:

first and second members which are rotated relative to one another a cylinder barrel having a plurality of substantially radially disposed cylinders, wherein each cylinder has a piston disposed therein, a support element which supports said second member through said cylinder barrel and pistons, wherein said support element and said cylinder barrel are rotatable with respect to one another, and wherein said support element is displaceable perpendicularly with respect to an axis of rotation, in order to adjust the distance between centers of the first and second members and the center of the support element, and further wherein spaces are formed in said cylinders between said pistons and said support element, such that when said support element is displaced from said axis of rotation said spaces increase or decrease when rotated, so that said converter acts as either a pump or a motor, and further wherein said support element is displaceable in a first direction to form a pump, and in a second direction to form a motor;

a spring member for biasing the support element in a first direction;

a balance piston for producing a force that acts to cancel the unbalanced force in the direction in which the support element is displaced;

a hydraulic actuator for displacing the support element in said second direction against the action of the spring member; and a hydraulic circuit which introduces a high pressure fluid used in the converter onto one end surface of the balance piston via a pressure-compensating valve to cause the balance piston to produce said force, such that the pressure of the high pressure fluid is maintained at or below the preset pressure value set for the pressure-compensating valve when the converter acts as a motor when the converter is supplied with an input of high pressure fluid, as well as when the converter acts as a pump.

* * * * *